United States Patent [19]

Pruszenski, Jr.

[11] Patent Number: 4,975,026

[45] Date of Patent: Dec. 4, 1990

[54] FREE-PISTON HEAT PUMP

[75] Inventor: Anthony Pruszenski, Jr., Newbury, Mass.

[73] Assignee: Energy Innovations, Inc., Mineral Wells, Tex.

[21] Appl. No.: 312,507

[22] Filed: Feb. 17, 1989

[51] Int. Cl.[5] ..... F04B 31/00

[52] U.S. Cl. ..... 417/340; 417/389

[58] Field of Search ..... 417/310, 383–389, 417/364, 340; 74/110

[56] References Cited

U.S. PATENT DOCUMENTS

| | | | |
|---|---|---|---|
| 2,501,030 | 3/1950 | Cronstedt | 417/340 |
| 2,807,215 | 9/1957 | Hawxhurst | 417/383 |
| 2,920,572 | 1/1960 | Schaurte | 417/389 |
| 3,030,892 | 4/1962 | Piccardo | 417/389 |
| 3,119,230 | 1/1964 | Kosoff | 417/340 |
| 3,125,282 | 3/1964 | Jänicke | 417/340 |
| 3,182,895 | 5/1965 | Panhard | 417/340 |
| 4,430,048 | 2/1984 | Fritsch | 417/383 |
| 4,474,540 | 10/1984 | Bonastia et al. | 417/388 |

FOREIGN PATENT DOCUMENTS

| | | | |
|---|---|---|---|
| 598560 | 12/1925 | France | 417/340 |
| 357868 | 6/1938 | Italy | 417/340 |
| 541779 | 12/1941 | United Kingdom | 417/340 |

*Primary Examiner*—Leonard E. Smith
*Assistant Examiner*—Robert N. Blackman
*Attorney, Agent, or Firm*—Milde & Robinson

[57] ABSTRACT

An end stop is disclosed for limiting the maximum displacement of a flexible member so as to minimize stress on this member and thus provide an extended surface life. The flexible member is rigidly supported at at least two spaced-apart points such that the flexible member can flex in the region between these points. The end stop includes a support member for clamping the flexible member at the two supporting points and a wall surface arranged in opposed, facing relationship to the flexible member in the region between the two points. The curvature of the wall surface is defined by first and second curves that form a continuous curvature and have first and second derivatives of the local angle $\phi$ of the tangent to the curve with respect to the distances along the curve which are zero.

15 Claims, 4 Drawing Sheets

FREE-PISTON HEAT PUMP

FIELD OF THE INVENTION

The present invention relates to hydraulic coupling diaphragms for providing transfer of mechanical energy between sealed fluid chambers. More particularly, the present invention relates to means for mechanically linking a free-piston internal combustion engine to a load.

DISCUSSION OF RELATED ART

Internal combustion engines can be used to power pumps and compressors, but some means must be found for transferring the necessary energy without contaminating the pumped fluids. Also, it is desireable to provide a hermetic seal for the pump to prevent contamination of the environment when refrigerants, solvents and other hazardous fluids are being pumped.

A durable hermetic seal between the engine compartment and the pumped fluid is needed, but difficult to achieve in such pumps. Bellows and diaphragm-type seals are commonly used with solid linkage, and the use of diaphragms in hydraulic coupling devices is also known. However, wear in the seals and fatigue in the hydraulic coupling diaphragms make these types of pumps costly to maintain. Friction between a piston rod and its seal also seriously reduces mechanical efficiency when diaphragm seals are used with solid linkage. Furthermore, leakage may cause the system to fail for lack of a working fluid, such as a refrigerant, or paticulates and corrosives may be transferred inadvertantly to critical parts of the system, thereby causing accelerated deterioration of the system.

It is also generally known that internal combustion free-piston compressors tend to work inefficiently at partial loads. Thus, during startup and at times when the load on the pump compressor is likely to be less, for instance when icing occurs in the heat exchanger on the compressor, the mechanical load on the compressor is commonly disabled temporarily, rather than permitting the engine to operate at partial load.

However, when the mechanical load is subsequently reconnected, problems related to improper impedance matching can cause severe mechanical strain on the system. Also, this shutdown of the compressor disrupts operation of the heat pump, reducing its ability to reliably control ambient temperature.

SUMMARY OF THE INVENTION

It is an object of the invention to provide energy transfer between environments that are hermetically-isolated from one another with very high mechanical efficiency and extended service life.

It is another object of the invention to provide mechanical impedance matching between two systems that are sealed from each other.

It is another object of the invention to provide a mechanical linkage having, in the alternative, a pseudo-constant, or linear, or programmed spring rate between two systems that are sealed from each other.

It is a further object of the invention to compensate for the undesirable effects of changes in the load produced by a heat pump, on a free-piston internal combustion engine that drives the heat pump, thereby avoiding shutdown of the compressor.

In accordance with the present invention first and second working surfaces of a flexible diaphragm are positioned opposite first and second wall surfaces of first and second chambers in the housing of an hermetically-sealed mechanical coupling, respectively. First and second working surfaces of the diaphragm are adapted to contact first and second working fluids in the respective chambers. The edges of the diaphragm are sealed to the chambers and one of the wall surfaces has an axisymmetric radial curvature having first and second curves that form a continuous curvature and have first and second derivatives that are substantially zero where the curves meet, whereby the curvature of the diaphragm at its maximum displacement is limited by said wall so as to provide an extended service life.

In accordance with a preferred embodiment of the invention, the diaphragm provides impedance matching between a free-piston internal combustion engine and its load and variable co-generation of electricity provides compensation for variations in the load.

In accordance with a preferred embodiment of the invention, the diaphragm provides impedance matching between a free-piston internal combustion engine and its load, and variable co-generation of electricity provides compensation for variations in the load.

BRIEF DESCRIPTION OF THE DRAWINGS

The nature and advantages of the present invention will be more clearly understood when the description of a preferred embodiment provided below is considered in conjunction with the drawings, wherein.

DETAILED DESCRIPTION OF THE PREFERRED EMBODIMENTS

Figure 1:
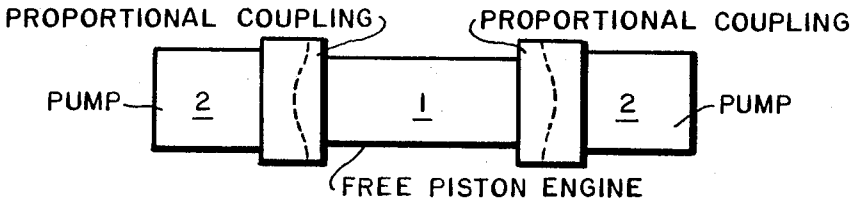
FIG. 1 is a schematic diagram of free piston heat pump apparatus.
Figure 2:
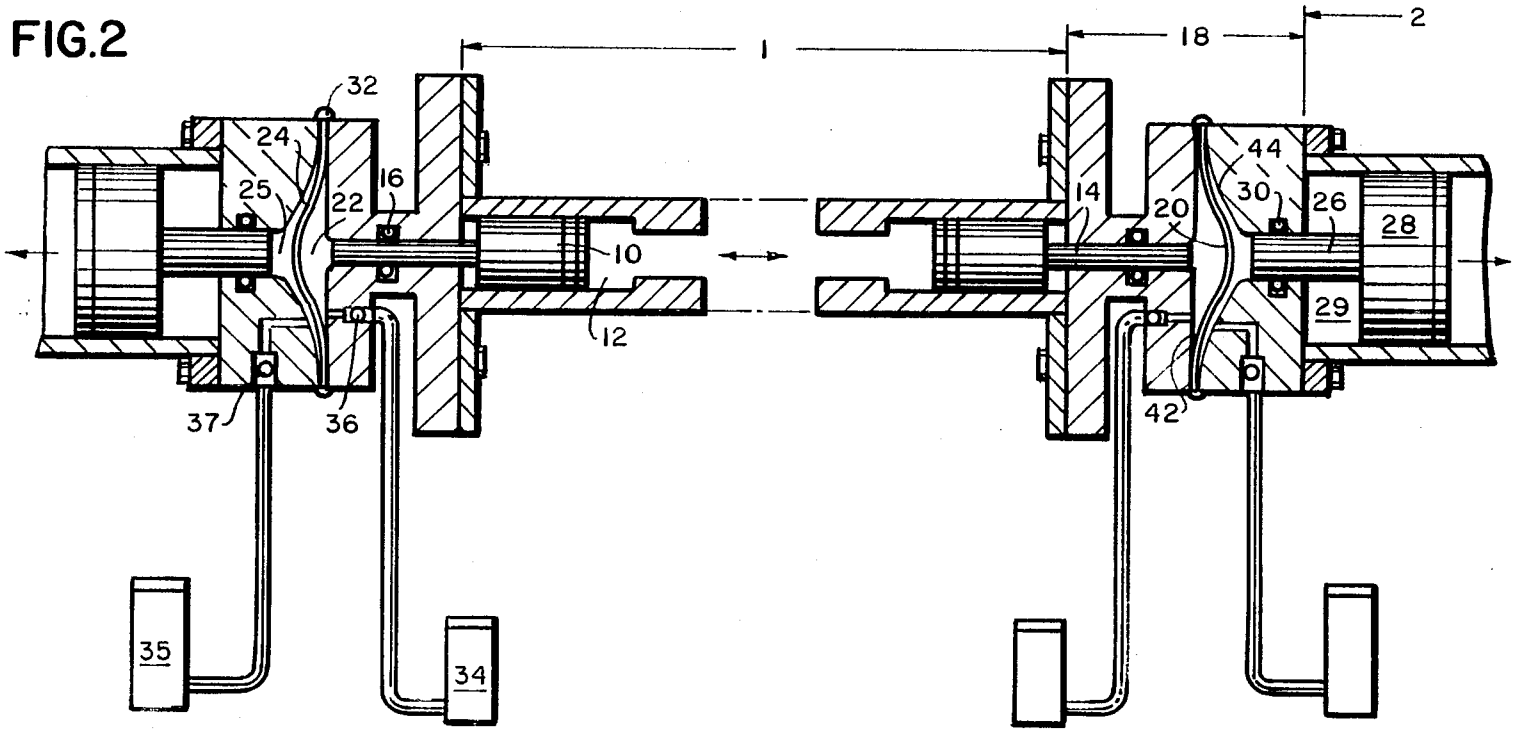
FIG. 2 is a diagram of apparatus in accordance with the present invention.

A free-piston engine adapted to drive an hermetically-sealed pump via a proportional coupling is shown in FIGS. 1 and 2. In the section view shown in FIG. 2, the two free pistons 10 can be seen. These pistons 10 are driven simultaneously outward by the force produced when fuel is burned in a combustion chamber (not shown) which is located between the pistons 10 and communicates with them thorough the pistons' cylinders 12 in the engine block 1.

In the preferred embodiment of the present invention, the pistons in the free-piston engine are forced back toward the center of the engine block 1 by the compressed refrigerant gas in the compressor pumps 2, after they are driven outward by the pressure produced when fuel is ignited in the combustion chamber. Thus the compression of the fuel mixture in the combustion chamber of the engine block 1 is provided by the pressure in the compressors 2.

Each piston 10 is connected to a rod 14 which is inserted through a bushing 16 into the housing 18 of the proportional coupling. The interior of the housing 18 is divided by diaphragm 20 into first and second fluid-filled chambers 22 and 24. The second chamber 24 has a bore 25 into which the connecting rod 26 of the compressor piston 28 is inserted through a bushing 30. In the preferred embodiment the ratio of the diameters of the pistons 28, 10 is 2.5:1. The chambers 22 and 24 are sealed by a weld 32 between the diaphragm 20 and respective portions of the housing 18 on each side of the diaphragm 20. Thus, both sides of the diaphragm 20 are hermetically sealed. This welded diaphragm provides a low-maintenance seal for a heat pump compressor 2 that prevents loss of refrigerant and contamination of the refrigerant gas by combustion products. It is also highly advantageous for pumps used in solvent recovery operations and in nuclear power installations, where containment of the pumped material is a critical consideration.

The pressure of the fluids in the first and second chambers 22, 24, in FIG. 2, is maintained by respective auxilliary pumps 34 and 35 through respective check valves 36 and 37. The spring rate in this coupling is substantially linear. In the preferred embodiment shown in FIG. 3, the spring rate of the hydraulic coupling across the diaphragm 20 is programmed to provide a softer linkage when the piston 28 moves beyond the vents 38 toward the engine by permitting fluid to escape from the second chamber 71. When both vents are closed by the movement of the piston toward the diaphragm, the fluid in the chamber 2 provides a substantially linear spring-rate function, as a bounded fluid volume. As the vents open, the fluid provides a spring rate that tends increasingly toward the constant spring rate that is characteristic of an infinite fluid volume, providing what is referred to as a "pseudo-constant" spring rate.

The location of the pistons in their respective chambers is sensed by magnetic switches 39*a* and 39*b*, and plunger switch 39*c* to provide fail-safe control of piston travel. These switches as actuated when a piston exceeds its normal range of travel and shut down the pump and the engine to prevent bottoming of the pistons in their cylinders from damaging the pump and engine apparatus.

The normal range of travel for the pistons 10, 28 is determined by the relationship between the static fluid pressures in the chambers 22, 24 and the relationship of these pressures to the pressures produced in the engine block 1 and in the pumps 2. In normal operation, however, the static fluid pressure in the chambers 22, 24 will decrease over time as fluid from these chambers migrates past the pistons 10, 28 toward the engine block 1 and the pump 2, respectively. Therefore, the oil in the chambers 22, 24 must be systematically replenished to control the travel of the pistons 10, 28.

In a free piston engine in accordance with the preferred embodiment, fluid at the normal static pressure of the first chamber is provided to the first chamber 22 through needle valve 40. Fluid is provided to the second chamber 24 through a plunger-actuated booster pump 41.

The needle valve 40 is controlled by an hermetically-sealed sensor diaphragm 20*a* that is rigidly connected to valve element 40*a* by a shaft 40*b*. When the pressure in the second chamber 24 exceeds the pressure in the first chamber 22, the sensor diaphragm opens the needle valve 40. Fluid at the normal static pressure for the first chamber 22 is then provided to the check valve 36, which opens when the pressure in the first chamber 22 falls below the normal static pressure. To assure that other changes in relative pressure do not interfere with the operation of the needle valve 40, the diameter of the back surface 40*c* of the valve element 40*a* is made much smaller than the corresponding surface of the sensor diaphragm 20*a*.

The sensor diaphragm 20*a* is supported by the first and second bulkhead wall surfaces in first and second chambers in the needle valve 40 that are substantially similar to the bulkhead wall surfaces 42, 44 of the proportional coupling shown in FIG. 2.

The booster pump 41 comprises a ball valve 41*a* and a plunger 41*b*. The check valve 37 remains closed until the pressure in the second chamber 24 falls below the normal static pressure of the fluid in the second chamber, or until the plunger 41*b* is actuated by the compressor piston 28 as it approaches the limit of its normal range of travel. Each time the plunger 41*b* is actuated, the booster pump 41 provides a small quantity of very high-pressure oil to the second chamber 24. This causes the range of travel for the compressor piston 28 to move slightly toward the compressor 2, away from plunger 41*b*.

In the preferred embodiment, a diesel engine is used to drive a compressor that uses FREON R22, the trademark name of a refrigerant gas that is well-known in the art. The fluid in the first chamber 22 is 20W lubricating oil. The fluid in the second chamber is a standard refrigeration oil. The pressure provided by the two oil sources and the static pressure on each side of the diaphragm 20 are all substantially equal and lie within the range of 100 to 200 psi when used for air conditioning. When used in low-temperature or cryogenic applications, the pressure range would be adjusted downward to around 40 psi.

The bulkhead wall surfaces 42, 44, and the flexible portion of diaphragm 20 between them, that is, the portion of the diaphragm 20 that is not fixed in position by the welds 32 and the other walls of the chambers 22, 24, are both axisymmetric and coaxial. In accordance with the present invention, the radial curvature of the bulkhead wall surface 44 in each respective second chamber 24 comprises respective first and second curvatures that are continuous with each other. The first curvature 46 extends from the aperture in the wall surface 44 that communicates with the bore 25 to the second, opposite curvature 48. The second curvature extends from the weld 32 toward the bore 25, along the same radius. The two curves meet at an inflection point 47. Together the two curves 46, 48 on the bulkhead wall surface 44 form a radial S-curve that is truncated by the aperture of the bore 25 in the bulkhead wall surface 44.

Each of the curves 46, 48 is a member of a family of continuous curves for which the first and second derivatives of the curves approach zero as the arc length of the curve extends out from the origin. The curves are joined so that where they are joined the meridian tangent angle $\phi$ has first and second derivatives with respect to the distances along the curve that are substantially zero. The tangent to the extension of the first curve 46 at the center of the bore 25 is perpendicular to the axis of symmetry where it intersects that axis. Similarly, the wall surface 42 at the periphery of the diaphragm 20 lies in a plane that is perpendicular to that axis.

Providing support for the diaphragm that limits its displacement to an axisymmetric curvature defined in accordance with the present invention improves its service life beyond what can be achieved by merely limiting the volume displaced by the diaphragm.

The preferred family of curves for use in this curvature is defined by the meridian tangent angle $\phi$:

$$\phi = -g_4[e^{-s}(s^3+3s+2)-2], \quad [1]$$

wherein $\phi_1 = g_4(6e^{-1}-2)$.

The value $g_4$ is a scalar constant and $\phi_1$ the value of $\phi$ where $S=1$. Other suitable families of curves are:

$$\phi = g_5]e^{-s}(s^3-3s^2+6s-1)+1] \quad [2]$$

wherein $\phi_1 = g_5(^3e^{-1}+1)$, and $$\phi = g_7[e^{-s}(-15s^5+s^4-21s^3+59s^2-120s+120) + 160se^{-1}-120]. \quad [3]$$

wherein $\phi_1 = g_7(184e^{-1}-120)$; the values $g_5$ and $g_7$ being scalar constants.

However, the curves from the preferred family of curves defined by equation [1] result in a relatively greater displacement than the displacement produced, by a curvature formed of curves defined by equation [2] and [3]. Thus the curves defined in terms of equation [1] provide more efficient energy transfer, while also providing improved service life.

To prevent excessive displacement of the center portion of the diaphragm 20, the portion of the diaphragm that lies over the bore 25 and is not supported by the bulkhead walls, is supported by a perforated antirupture disk 50. The antirupture disk 50 is inserted in the bore fluid opening in the housing that communicates with the piston rod and, in the preferred embodiment thereof, continues the first curve 46 to the axis of symmetry.

In the preferred embodiment, the corresponding wall surface 42 of the first chamber 22 has a slight negative curvature to prevent the diaphragm 20 from reversing its curvature. The curves forming the negative curvature are preferably also members of the families of curves defined for the other wall surface 44. Alternatively, a flat wall surface may be provided in the first chamber 22.

Figure 3:
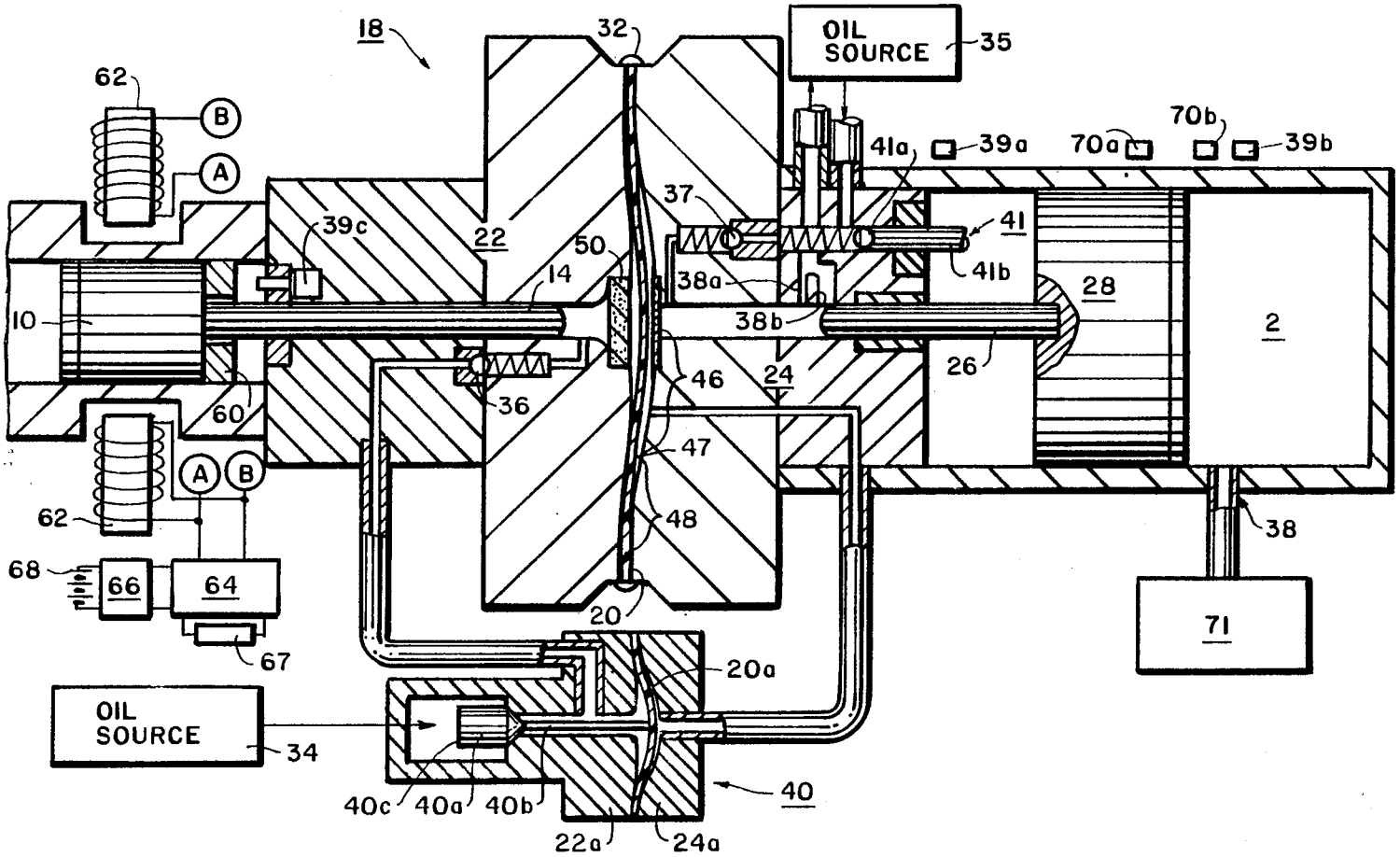
FIG. 3 is a schematic diagram of a preferred embodiment of the present invention.
Figure 4:
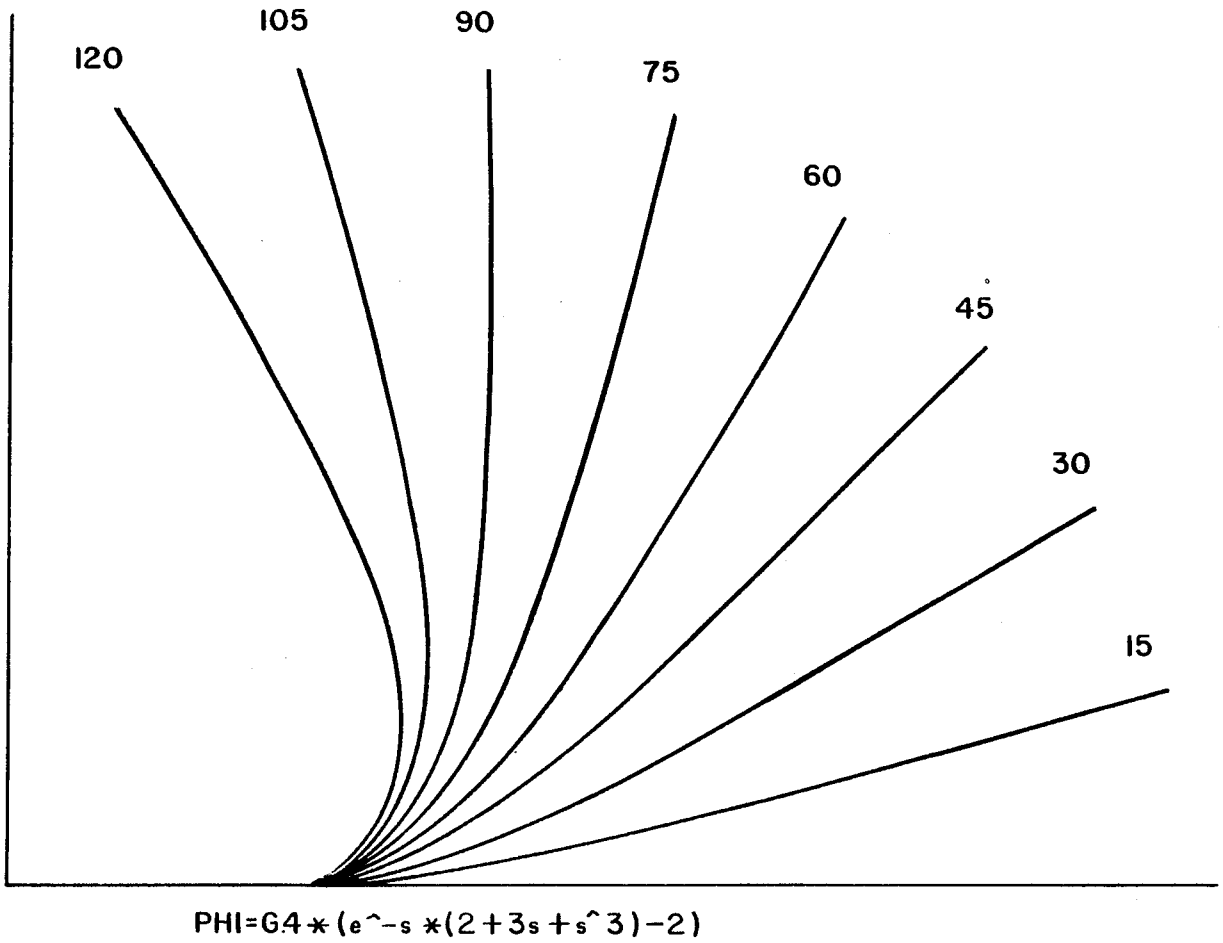
FIG. 4 is an illustration of the family of curves defined in terms of $g_4$.
Figure 5:
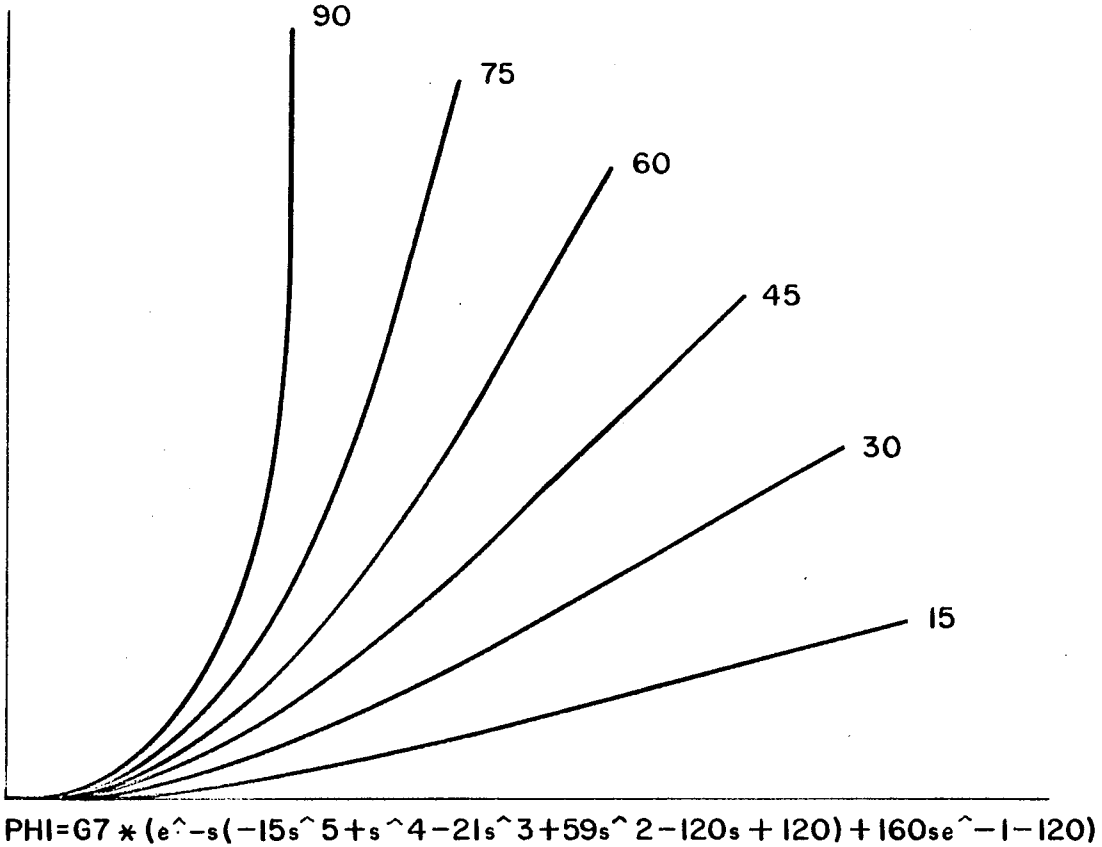
FIG. 5 is an illustration of the family of curves defined in terms of $g_7$.

FIG. 3 also shows further detail of the structure of pistons 10 that are located on either side of the combustion chamber (not shown) in the engine block 1. Each of these pistons 10 includes a permanent magnet 60 which crosses between magnetic field coils 62 thereby setting up an alternating current in the field coils 62. The field coils are connected in parallel at connection points A,B. A load controller 64 varies the total impedence of the electrical loads 67, 68 connected to the field coils 62. The field coils 62 magnetically couple the loads 67, 68 to the permanent magnet 60 in the piston 10, so that the total mechanical load on the free-piston engine remains substantially constant as the load on the compressors 2 varies. One of the loads attached to the regulator 66 is a storage cell 68 which is connected to the regulator through a rectifier 70.

The additional load provided by this cogeneration of electrical power is particularly important when icing occurs. Icing of the compressor's heat exchanger decreases the static refrigerant pressure in the compressor. The compressor piston 28 then moves closer to the compressor in its travel. However, before the piston 28 reaches fail-safe switch **39*b* in its travel, it will actuate both load control switches 70*a* and 70*b*. Switch 70*a* will be actuated in the course of every piston stroke, during normal operation. Switch 70*b*** will be actuated in the event of compressor icing or some other decrease in refrigerant fluid pressure.

As long as switch **70*a* is actuated during each stroke of the piston 28, the load controller 64 will charge the battery 68, which provides power to run the heat pump's starter motor. This load will be shed and a warning light will be lighted if switch 70*a*** is not actuated during each stroke. This indicates that piston travel has decreased to a point where the stroke of the piston is insufficient to provide adequate compression to the fuel mixture in the combustion chamber.

When switch **70*b* is actuated the load magnetically coupled to the piston 10 will be sharply increased by the load controller 64 to restrain piston travel. The load controller 64 will then continue to increase the load each time the switch 70*b* is actuated by a sequence of piston strokes. The load controller will gradually shed the load that was added in response to switch 70*b* after a stroke occurs that does not actuate switch 70*b***.

The invention has been described with reference to a particular embodiment thereof. It will be apparent to one skilled in the art that modifications and variations are possible with in the spirit and scope of this invention, which is defined by the claims listed below.

I claim:

1. An hermetically-sealed mechanical coupling for transferring a first force and motion on one side of the coupling to a second force and motion on the opposite side of the coupling, said first force and motion being proportional to said second force and motion, said coupling comprising:

a housing having first and second chambers, each chamber having a wall surface, said wall surfaces being arranged in opposed, facing relationship; and a diaphragm positioned between said first and second chambers, said diaphragm having first and second working surfaces on opposite sides thereof facing respective ones of said wall surfaces, said working surfaces being adapted to contact first and second working fluids, respectively, the edges of said diaphragm being sealed to said chambers;

a surface with a radial curvature on one of said wall surfaces that is coaxial with said respective working surface, said curvature including first and second curves forming a continuous curvature and having first and second derivatives of the local angle $\phi$ of the tangent to the curve with respect to the distance s along the curve which are zero, whereby the curvature of the diaphragm at its maximum displacement is limited to as to provide an extended service life.

2. The mechanical coupling of claim 1 wherein one wall surface is planar so as to prevent stress reversal in the diaphragm.

3. The mechanical coupling of claim 1 wherein one wall surface has a negative curvature to prevent stress reversal in the diaphragm.

4. The mechanical coupling of claim 1 wherein said curvature includes a curve for which the tangent angle $\phi$ is defined by the following function of the curve's arc length "s":

$$\phi = g_4[e^{-s}(s^3+3s+2)-2],$$

wherein $]\phi_0]\phi_1 = g_4(6e^{-1}-2)$, when $s=1$ and where $q_4$ is a constant;

5. The mechanical coupling of claim 1 wherein said curvature includes a curve for which the tangent angle $\phi$ is defined by the following function of the curve's arc length "s":

$$\phi = g_5[3^{-s}(s^3 - 3s^2 + 6s - 1) + 1],$$

wherein $[\phi_0 = g_5(e^{-1} + 1)]\phi_1 = g_5(3e^{-1} + 1)$, when $s = 1$ and where $g_5$ is a constant;

6. The mechanical coupling of claim 1 wherein said curvature includes a curve for which the tangent angle $\phi$ is defined by the following function of the curve's arc length "s":

$$\phi = g_7[e^{-s}(-15s^5 + s^4 - 21s^3 + 59s^2 - 120s + 120) + 160se^{-1} - 120].$$

wherein $[\phi_0]\phi_1 = g_7\ (184e^{-1} - 120)$, when $s = 1$ and where $g_7$ is a constant.

7. The mechanical coupling of claim 1 further comprising first and second reservoirs for providing first and second working fluids, respectively, and check valves connecting said reservoirs to said respective chambers, whereby the working fluids in said chambers are replenished.

8. An hermetically-sealed mechanical coupling for transferring a first linear force and motion on one side of the coupling to a second linear force and motion on the opposite side of the coupling, said first force and motion being proportional to said second linear force and motion, said coupling comprising:

a housing having first and second chambers, each chamber having a wall surface, said wall surfaces being arranged in opposed, facing relationship; and a diaphragm positioned between said first and second chambers, said diaphragm having first and second working surfaces on opposite sides thereof facing respective ones of said wall surfaces, said working surfaces being adapted to contact first and second working fluids, respectively, the edges of said diaphragm being sealed to said chambers;

a surface with a radial curvature on one of said wall surfaces that is coaxial with said respective working surface, said curvature including first and second curves forming a continuous curvature, and having first and second derivatives of the local angle $\phi$ of the tangent to the curve with respect to the distance s along the curve which are zero, whereby the curvature of the diaphragm at its maximum displacement is limited so as to provide an extended service life; and

9. A free-piston internal combustion engine pump apparatus comprising:

an internal combustion engine having a first working fluid chamber;

a pump, having a second working fluid chamber, mechanically linked to said first working chamber;

an axisymmetric wall surface in each chamber, said wall surfaces being arranged in opposed, facing relationship; and a diaphragm positioned between said first and second chambers, said diaphragm having first and second working surfaces on opposite sides thereof facing respective ones of said wall surfaces, said working surfaces being adapted to contact first and second working fluids, respectively, the edges of said diaphragm being sealed to said chambers;

a surface with a radial curvature on one of said wall surfaces that is coaxial with said respective working surface, said curvature including first and second curves forming a continuous curvature, and having first and second derivatives of the local angle $\phi$ of the tangent to the curve with respect to the distance s along the curve which are zero, whereby the curvature of the diaphragm at its maximum displacement is limited so as to provide an extended service life.

10. The compressor apparatus of claim 9 further comprising variable load means adapted to compensate for variations in the mechanical load produced by the pump.

11. The compressor apparatus of claim 10 wherein the pump is a heat pump compressor and the variable load means is an electric generator.

12. Apparatus for limiting the maximum displacement of a flexible member so as to minimize stress on this member, said apparatus comprising:

a flexible member adapted to be rigidly supported at least two spaced apart points, said flexible member being arranged to flex in the region between said points;

a support member having means for clamping said flexible member at said at least two points and having a wall surface arranged in opposed, facing relationship to said flexible member in said region between said at least two points;

the curvature of said wall surface including first and second curves forming a continuous curvature and having first and second derivatives of the local angle $\phi$ of the tangent on the curve with respect to the distance s along the curve which are zero, whereby the curvature of the flexible member at its maximum displacement is limited so as to provide an extended surface life.

13. The apparatus defined in claim 12, wherein said curvature includes a curve wherein the tangent angle $\phi$ is defined by the following function of the curve's arc length "s":

$$\phi = -g_4[e^{-s}(s^3 + 3s + 2) - 2],$$

wherein $\phi_1 = g_4(6e^{-1} - 2)$, when $s = 1$ and where $g_4$ is a constant.

14. The apparatus defined in claim 12, wherein said curvature includes a curve wherein the tangent angle $\phi$ is defined by the following function of the curve's arc length "s":

$$\phi = g_5[e^{-s}(s^3 - 3s^2 + 6s - 1) + 1]$$

wherein $\phi_1 = g_5(3e^{-1} + 1)$, when $s = 1$ and where $g_5$ is a constant.

15. The apparatus defined in claim 12, wherein said curvature includes a curve wherein the tangent angle $\phi$ is defined by the following function of the curve's arc length "s":

$$\phi = g_7[e^{-s}(-15s^5 + s^4 - 21s^3 + 59s^2 - 120s + 120) + 160se^{-1} - 120].$$

wherein $\phi_1 = g_7\ (184e^{-1} - 120)$, when $s = 1$ and where $g_7$ is a constant.

* * * * *